US006208316B1

(12) United States Patent
Cahill

(10) Patent No.: US 6,208,316 B1
(45) Date of Patent: Mar. 27, 2001

(54) FREQUENCY SELECTIVE SURFACE DEVICES FOR SEPARATING MULTIPLE FREQUENCIES

(75) Inventor: Robert Cahill, Chepstow (GB)

(73) Assignee: Matra Marconi Space UK Limited, Middlesex (GB)

( * ) Notice: Subject to any disclaimer, the term of this patent is extended or adjusted under 35 U.S.C. 154(b) by 0 days.

(21) Appl. No.: 08/927,638

(22) Filed: Sep. 11, 1997

Related U.S. Application Data

(63) Continuation of application No. 08/537,613, filed on Oct. 2, 1995, now abandoned.

(51) Int. Cl.[7] ..... H01Q 15/23
(52) U.S. Cl. ..... 343/909; 333/134; 333/202
(58) Field of Search ..... 343/909; 333/202, 333/134

(56) References Cited

U.S. PATENT DOCUMENTS 3,975,738 * 8/1976 Pelton et al. ..... 343/909 X
4,125,841 * 11/1978 Munk ..... 343/909
4,467,330 * 8/1984 Vidal et al. ..... 343/909 X
4,476,471 10/1984 Sato et al. .
4,684,954 * 8/1987 Sureau et al. ..... 343/909
4,701,765 * 10/1987 Arduini et al. ..... 343/909 X
5,130,718 * 7/1992 Wu et al. ..... 343/909 X
5,208,603 * 5/1993 Yee ..... 343/909
5,373,302 * 12/1994 Wu ..... 343/909 X

FOREIGN PATENT DOCUMENTS

2518828 * 6/1983 (FR) ..... 343/909

OTHER PUBLICATIONS

Onde Electrique, vol. 71, No. 5, Sep. 1, 1991 pp. 54–61 "Conception er Realisation D'un Radiometre en Ondes Millimetriques pour le Sondage".
Bell System Technical Journal, vol. 54, No. 2, pp. 263–283, Feb. 1975 "Resonant–Grid Quasi–Optical Diplexers".

* cited by examiner

*Primary Examiner*—Benny T. Lee
(74) *Attorney, Agent, or Firm*—Donald Casey, Esq.

(57) ABSTRACT

A frequency selective surface devise is described. The device separates or combines two channels by using two or three spaced layers of resonant elements which may be loops or tripoles and which are coupled and which have interactive effects between layers such that the relatively broad transmission and reflection bands characteristic of resonant elements are modified by reinforcement of multiple reflection between the layers in the manner of a Fabry-Perot etalon effect in order to increase the sharpness of the transition of the transmission and reflection bands and thereby to permit combination or separation of closely spaced channels.

12 Claims, 6 Drawing Sheets

FIG. 7
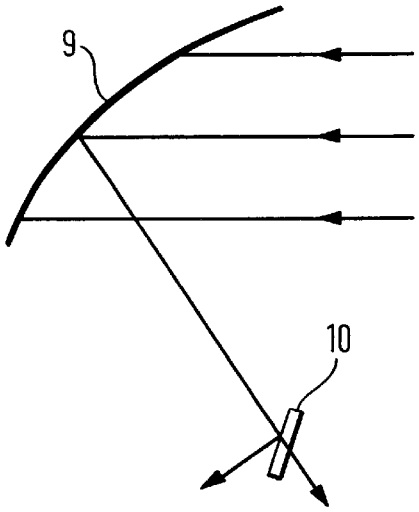
FIG. 8
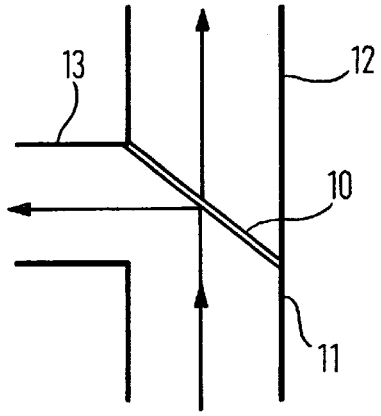
FIG. 9
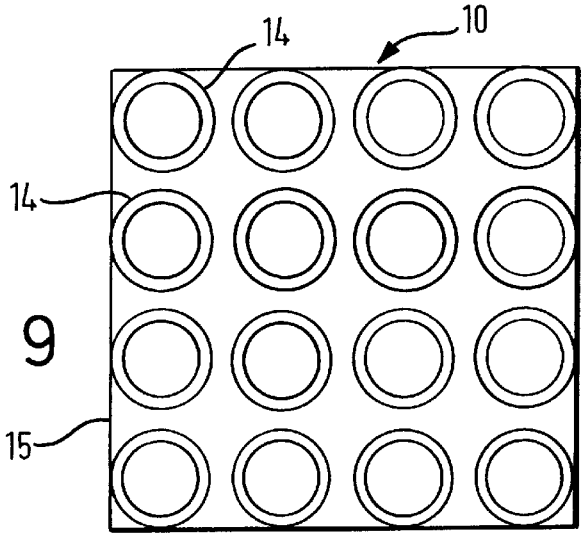
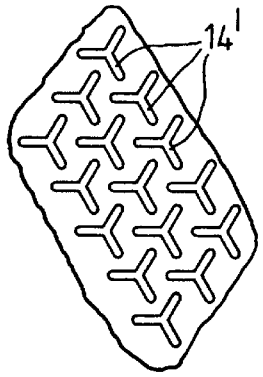
FIG. 15.
FIG. 10a
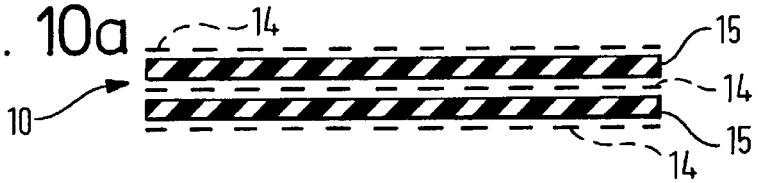
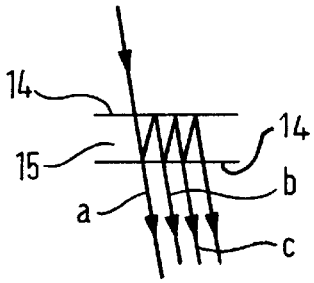
FIG. 10b

T.E. MODE

T.M.MODE

FREQUENCY SELECTIVE SURFACE DEVICES FOR SEPARATING MULTIPLE FREQUENCIES

This application is a continuation of application Ser. No. 08/537,613 filed Oct. 2, 1995 now abandoned.

FIELD OF THE INVENTION

This invention relates to frequency selective surface devices for separating or combining two channels of electromagnetic radiation.

BRIEF DESCRIPTION OF THE PRIOR ART

Each channel so separated or combined may in turn be sub-divided or sub-combined using another frequency selective surface device of the kind to which the invention relates, or using another type of separator or combiner.

One example of a frequency selective surface is shown in FIG. 1. Incoming energy having spot frequencies $f_1$ and $f_2$ is separated at the frequency selective surface 1 into a reflected beam $f_2$ and a transmitted beam $f_1$. As shown, the frequency selective surface in FIG. 1 separates the two frequencies $f_1$ and $f_2$. However, the device is reciprocal and can be used for combining frequencies $f_1$ and $f_2$ if the directions of incidence are reversed. A possible frequency response for such a frequency selective surface 1 is shown in FIG. 2. The transmission band is defined as the band of frequencies over which in excess of 90% of the incident energy is transmitted, and the reflection band is defined as the band over which in excess of 90% of the incident energy is reflected. While transmission and reflection bands are referred to in this text as for a 10% percentage loss in energy, it is possible to define the bands for other percentage transmission or reflection losses. In FIG. 2, the transmission band extends from a lower limit $T_L$ to an upper limit $T_U$ and the reflection band extends from a lower limit $R_L$ to an upper limit $R_U$.

One use of such frequency selective surface devices is for increasing channel capacity of reflector antennas, particularly in satellite communications, but also in terrestrial use. A single transmit reflector may be fed by two or more feed horns, or a single receive reflector may direct radiation into two or more feed horns. The frequency selective surface device transmits a large percentage of the energy incident on it in one frequency band and reflects a large percentage of the energy incident on it in another frequency band, and the physical separation or combination of the beams permits the use of one reflector with two feed horns. Each feed horn can then be optimized to the reflector for its particular frequency band. The frequency selective surface device may be mounted in a waveguide assembly to filter energy as a waveguide beamsplitter. However, such frequency selective surface devices are also used as quasi-optical beamsplitters in multi-band radiometers (devices for detecting radiation, usually low-level and usually natural radiation). They are particularly applicable to high frequencies such as wavelengths in the region of centimetres, millimetres and in the sub-millimetre range and beyond into the infra-red region, but are of course generally applicable across the whole electromagnetic spectrum.

Frequency selective surfaces may be used singly or in cascade. Each such frequency selective surface has a conductive pattern on a substrate.

One such pattern is a lattice grid. In one proposal (U.S. Pat. No. 4,476,471), a three layer lattice grid has been proposed, the three layers 2, 3, 4 (FIG. 3) being used so that interactions between the layers generate a broad transmission band (FIG. 4). Unlike the surface whose frequency response is illustrated in FIG. 2, which is a low pass arrangement, the lattice grid provides a high pass response. The response of a single layer is shown by the dotted line and the full line shows the effect of the three layers together. Even after the sharpening effect of the three layers, the ratio between the lower edge of the transmission band and the upper edge of the reflection band is still around 1:1.2.

Another proposed form of frequency selective surface consists of an array of conductive rings 5 (FIG. 5) which are printed onto a dielectric substrate 6. (E. A. Parker and S. M. A. Hamdy, "Rings as elements for frequency selective surfaces", Electron. Lett., Vol. 17, No. 17, 1981, pp 612–614). The individual rings are an integral multiple of the wavelength of the incident radiation in circumference and are therefore resonant, as well as being coupled to each other. The result of this is a sharper transition between transmission and reflection bands, as shown in full line in FIG. 6. Nevertheless, the ratio between the lower edge of the reflection band and the upper edge of the transmission band is typically 2.5:1 to 3.01:1.

It has also been proposed to use "double resonant" elements on the substrate such as 7 or 8. While these are shown in cutaway regions, in practice the entire array would be uniformly made of each of these elements in place of the rings. The rings 5 are single resonant in the sense that they can resonate at only one series of related frequencies (which will be harmonically related in the case of normal incidence and assuming that the electrical properties of the dielectric do not vary with frequency, but in which the higher order resonances in particular shift with frequency for inclined angles of incidence on the frequency selective device). The double resonant elements have smaller additional sections which are separately resonant. Thus, the double ring 7 is resonant at integral multiples of the circumference of the outer ring and integral multiples of the circumference of the inner ring (for normal incidence). The Maltese cross (also called a Jerusalem cross) 8 is resonant at integral multiples of the length of its dipoles as well as the integral multiples of the length of its endcaps (again, for normal incidence). The effect of these additional resonances is to produce an additional reflection band, as shown by the broken line in FIG. 6, so that the upper transmission band is pushed closer to the lower transmission band, and this reduces the ratio of the edge of the upper transmission band to the edge of the reflection band to around 1.3:1. The device is a high pass device. The printed resonant element array of FIG. 5 is usually used singly, but proposals have been made to use an array of squares in cascade (R. Cahill, I. M. Sturland, J. W. Bowen, E. A. Parker, and A. C. de Lima, "Frequency selective surfaces for millimetre and sub-millimetre wave quasi optical demultiplexing", Int. J. of Infrared and Millimetre Waves, Vol. 14, No. 9, 1993 pp 1769–1788), and also an array of Jerusalem crosses in cascade (J. A. Arnaud and F. A. Pelow, "Resonant Grid Quasi-Optical Diplexers", Bell System Technical Journal, Feb. 1975 Vol. 54 No. 2 pp 263–283).

However, recently more stringent filtering requirements have been defined with the development of space-bome radiometers which are designed to survey emissions over the sub-millimetre band in the earth's upper atmosphere. Here certain species which are of interest to atmospheric chemists emit energy over frequency bands which are very closely spaced, with edge band ratios of 1.03:1 or less. Such radiometers are normally fed by a single reflector antenna

SUMMARY OF THE INVENTION

The invention provides a frequency selective surface device for separating or combining two channels, which comprises at least two frequency selective surfaces, each defining a transmission band and a reflection band of frequencies, each comprising an array of coupled resonant elements. These elements are resonant at only one series of related frequencies, so that the transmission and reflection bands defined are relatively broad, and wherein the spacing of the surfaces is such that multiple reflections between the surfaces results in the reinforcement of these reflections on emergence, whereby the transmission and reflection bands have a relatively sharp transition, permitting combination or separation of closely spaced channels.

The use of interference effects between the layers to provide reinforcement of the reflections on emergence, together with the use of an array of single resonant elements, permits frequency selective surface devices to be constructed which have channels spaced as closely as 1.03:1 ratios between the lower edge of the reflection band and the upper edge of the transmission band. While single resonant elements in the form of a square have been used before in cascade, the spacing has not been such as to take advantage of the reinforcement of the reflections on emergence to produce the closely spaced channels.

Advantageously the resonant elements are resonant loops, such as rings (not necessarily circular), or squares. Instead, however, tripoles consisting of three half-wavelength arms arranged at 120° to each other may be used as the resonant elements. Alternatively, the array may be of such loops such as rings, squares, or tripoles, wherein the elements are slots in a continuous conductive surface. This would serve to provide a reciprocal of the characteristic provided by the elements themselves.

Two layers may be used, but preferably three layers are used and, in each case, adjacent layers should be spaced by a maximum separation of one half a wavelength in the medium between the surfaces, so that the emerging waves reinforce on emergence, after taking into account the phase change that will occur on reflection at each array of resonant elements.

BRIEF DESCRIPTION OF THE DRAWINGS

A frequency selective surface device constructed in accordance with the invention will now be described, by way of example, with reference to the accompanying drawings, in which:

FIG. 7 is a schematic of a ray diagram showing part of a space craft radiometer using the frequency selective surface device of this invention.

FIG. 8 is a schematic plan view of a T-junction of a wave guide showing the frequency of selective surface device of this invention fitted as a beam splitter.

FIG. 9 is a plan view of another embodiment of the frequency selective surface device of this invention.

FIG. 10*a* is a fragmentary side view of the frequency selective surface device of FIG. 9 partly exploded for clarity;

FIG. 10*b* is an enlarged schematic fragmentary view of the top two layers of the embodiment of FIG. 9 showing the top two layers of rings only with substrate sandwiched therebetween.

FIG. 15 is a schematic representation of an array of tripole resident elements.

Referring to FIG. 7, the space-borne radiometer is illustrated in simplified form and is designed to survey emissions over the sub-millimetre band in the earth's upper atmosphere. Incoming radiation impinges on the reflector 9, and the radiation is split into transmitted and reflected beams at the frequency selective surface device of the invention 10. The frequency selective surface device 10 can also be used to split beams propagating along waveguides, as shown in FIG. 8, and the beam incident along the section of waveguide 11 is split into a transmitted frequency band propagating along section 12 and a reflected frequency band propagating along T-junction 13.

Figure 1:
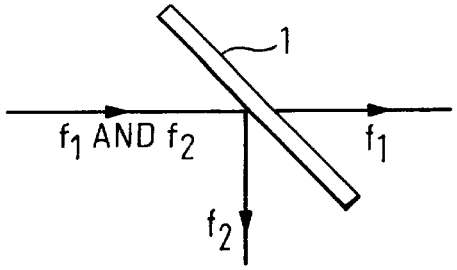
FIG. 1 (PRIOR ART)
FIG. 1 is a schematic view showing a conventional frequency selective surface.
Figure 2:
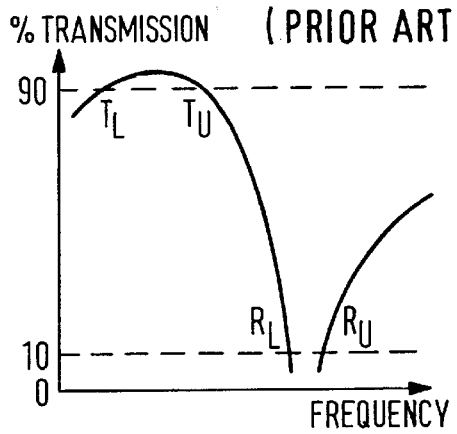
FIG. 2 (PRIOR ART)
FIG. 2 is a graph depicting frequency versus percent transmission for frequency selective surface of FIG. 1.
Figure 3:
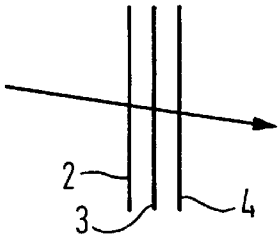
FIG. 3 (PRIOR ART)
FIG. 3 is a schematic representation of another known frequency selective surface.
Figure 4:
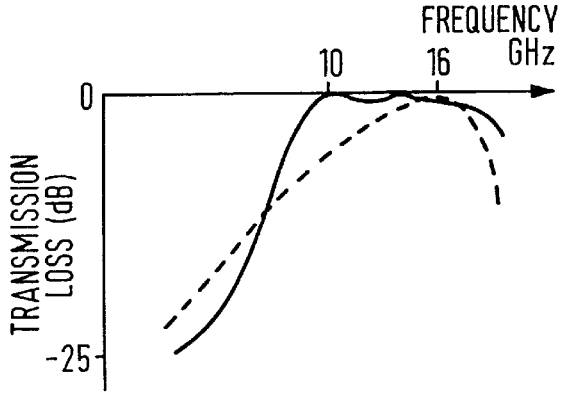
FIG. 4 (PRIOR ART)
FIG. 4 is a graph depicting in full line transmission loss in dB as a function of frequency for electromagnetic radiation incident on the frequency selective surface of FIG. 3, the dotted line showing the transmission loss of a single layer.
Figure 5:
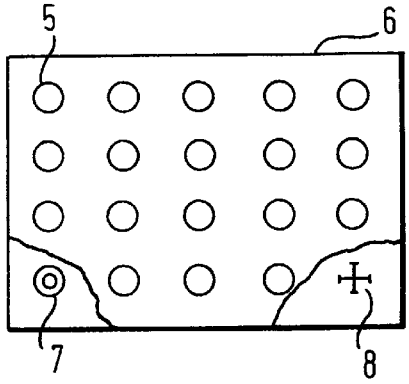
FIG. 5 (PRIOR ART)
FIG. 5 is a schematic representation of another known frequency selective surface.
Figure 6:
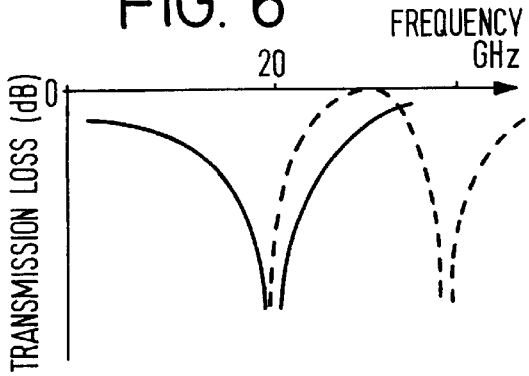
FIG. 6 (PRIOR ART)
FIG. 6 is a graph depicting in full line transmission loss in dB as a function of frequency for electromagnetic radiation incident on the selective surface of FIG. 5, the dotted line showing the transmission loss of a frequency selective surface made of an array of double resonant elements.

The frequency selective surface device 10 is illustrated in FIGS. 9 and 10*a* and 10*b*.

The device 10 consists of rings 14 of conducting material e.g. copper photo-etched onto a dielectric substrate 15. There are three layers of rings and two substrates, and the structure is manufactured by producing one screen with rings printed on both sides of the layer of dielectric and the other screen with the rings only on one side, and then sandwiching the two together.

Suitable dimensions and materials for the structure are as follows. The laminate may be glass reinforced PTFE such as that sold under the trade name Duroid, a typical thickness is 3.1 mm and typical permittivity of 2.33. Typical dimensions for the outside diameter of the ring are 4.5 mm and for the inside diameter 3.6 mm, and a typical spacing is about 6.7 mm. A typical thickness of copper is 10 $\mu$m. Such a structure has been found suitable for radiation of the frequency range 8 to 26 GHz. For operation in the range 300–400 GHz, the substrate could be fused silica (Permittivity of 3.78), the conducting film thickness could be 2 $\mu$m, the substrate typical thickness could be 100 $\mu$m, the mean diameter of the rings could be 150 $\mu$m with a periodicity of 300 $\mu$m.

The spacing of adjacent layers of resonant rings is critical, and is chosen tb be a maximum of one half of a wavelength in the substrate in the band for which the device is designed, typically a maximum of one half of the wavelength of the frequency at the upper edge of the transmission band. This typical value has been found to be a good compromise. Obviously, the reinforcement will be less than total for other wavelengths and differing angles of incidence, where the path length of the multiple reflections will be different. Referring to FIG. 10*b*, the spacing is such that radiation incident on the top surface of the device and reflected back and forth between the first and second layer of rings 14, emerges from the second layer of rings 14 in phase and therefore reinforces itself. FIG. 10*b* does not show the second layer of dielectric and third layer of rings. Thus, for example, ray b has undergone a phase change firstly at the lower layer of resonant rings 14 and secondly at the upper layer of resonant rings 14, before it emerges. The spacing between the layers is such that ray b emerges exactly one whole wavelength behind ray a. Ray c is a whole wavelength behind ray b. Thus the thickness of substrate 15 must be less than one half of a wavelength in the substrate. The invention is applicable to any integral number of wavelengths between rays a, b, c but one wavelength difference is preferred. The reinforcement on emergence of course applies after the second layer 15 and rings 14 have been traversed.

Figure 11A:
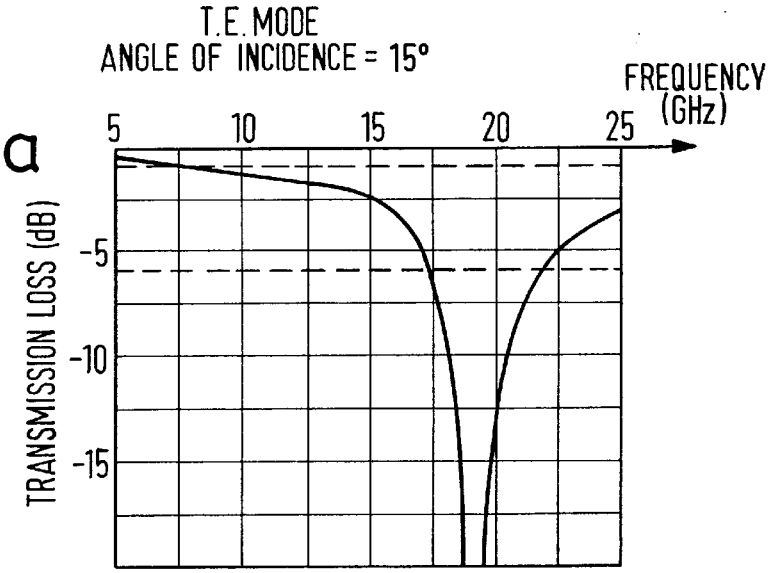
FIG. 11*a* is a graph depicting transmission loss in dB as a function of frequency for electro-magnetic radiation in the T.E. mode incident at 15 degrees on a frequency selective surface device which is a single layer of the three layer structure of FIGS. 9, 10*a*, and 10*b*, there being a lower transmission band, a reflection band and an upper transmission band.
Figure 11B:
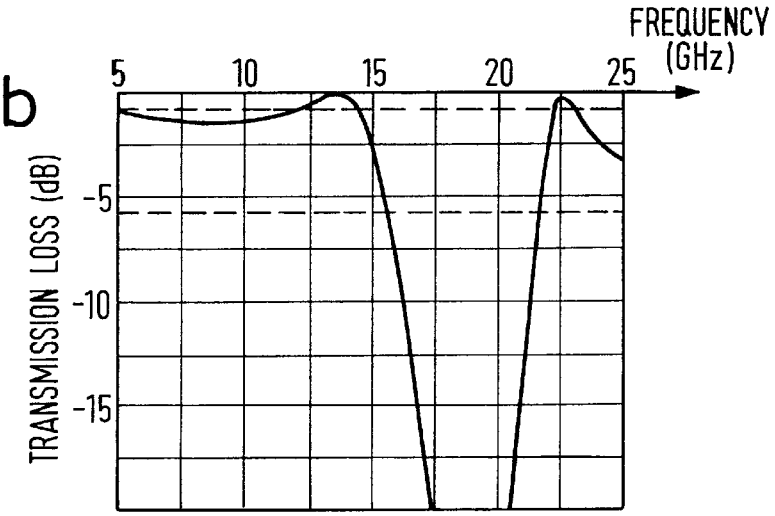
FIG. 11*b* is a graph similar to FIG. 11*a* wherein the frequency selective surface device is two layers of the three layer structure of FIGS. 9, 10*a* and 10*b*, there being a wider reflection band and a sharper transition between the lower transmission band and the reflection band.
Figure 11C:
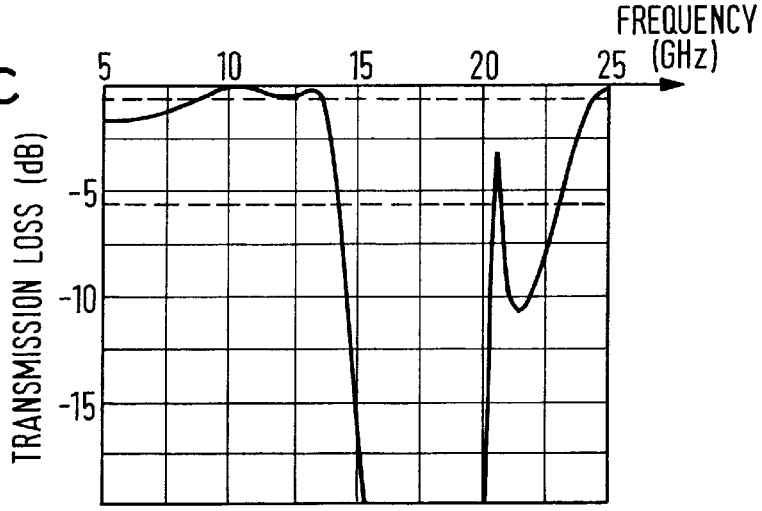
FIG. 11*c* is a graph similar to FIG. 11*a* and 11*b* wherein the frequency selective surface device is the device shown in FIG. 9, 10*a*, and 10*b*, there being a still wider reflection band and a still sharper transition between the lower transmission band the reflection band.
Figure 12A:
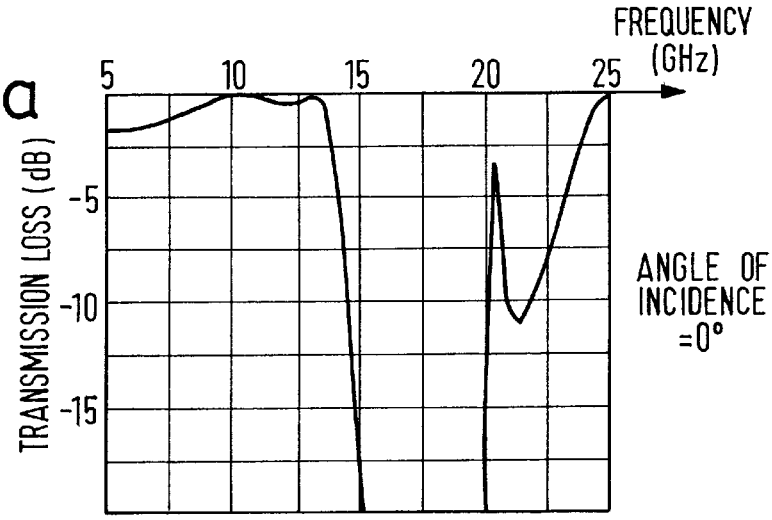
FIG. 12*a* is a graph depicting transmission loss in dB as a function of frequency for electromagnetic radiation in the T.E. mode at an angle of incidence of 0 degrees to the frequency selective surface device of FIG. 9, 10*a* and 10*b;*
Figure 12B:
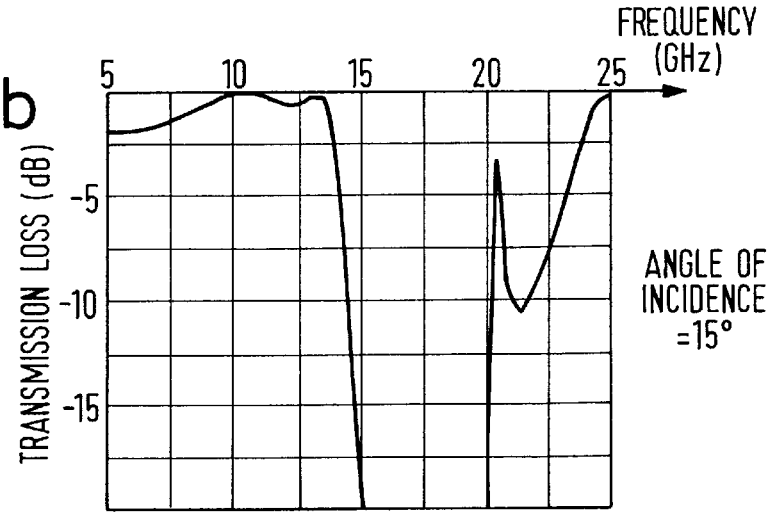
FIG. 12*b* is a graph similar to FIG. 12*a* wherein the angle of incidence is 15 degrees.
Figure 12C:
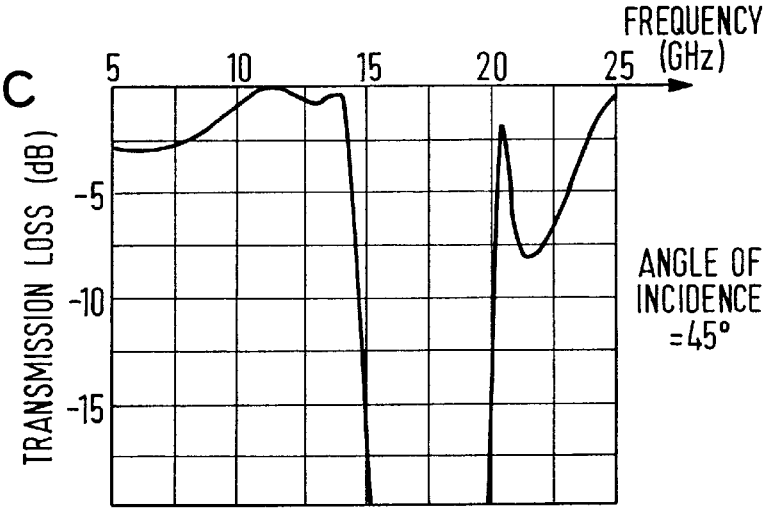
FIG. 12*c* is a graph similar to FIGS. 12*a* and 12*b* wherein the angle of incidence is 45 degrees.
Figure 13A:
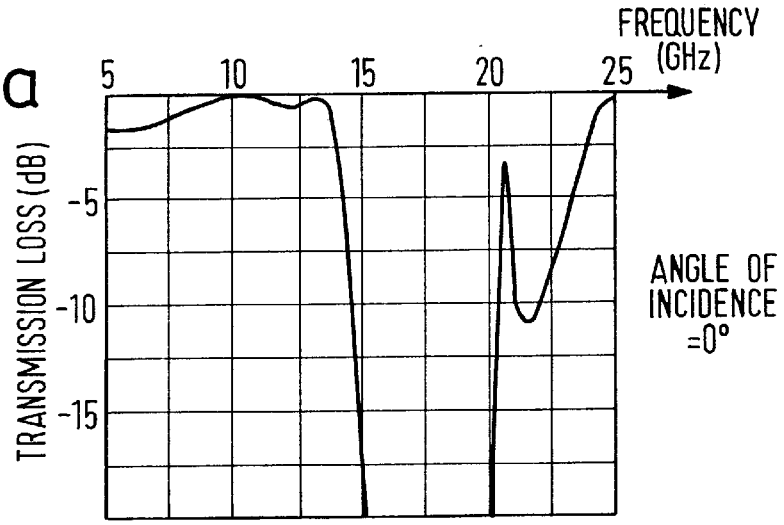
FIG. 13*a* is a graph depicting transmission loss in dB as a function of frequency for eletromagnetic radiation in the T.M. mode at an angle of incidence of zero degrees to the frequency selected surface device of FIG. 9, 10*a* and 10*b;*
Figure 13B:
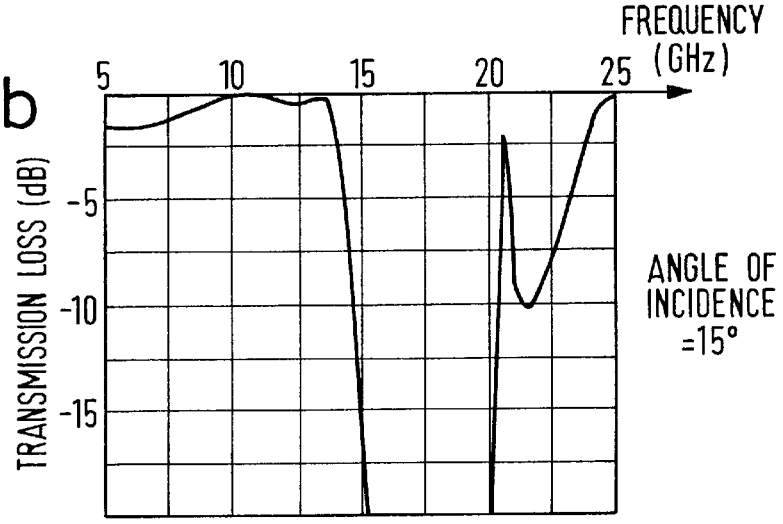
FIG. 13*b* is a graph similar to FIG. 13*a* where an angle of incidence is 15 degrees.
Figure 13C:
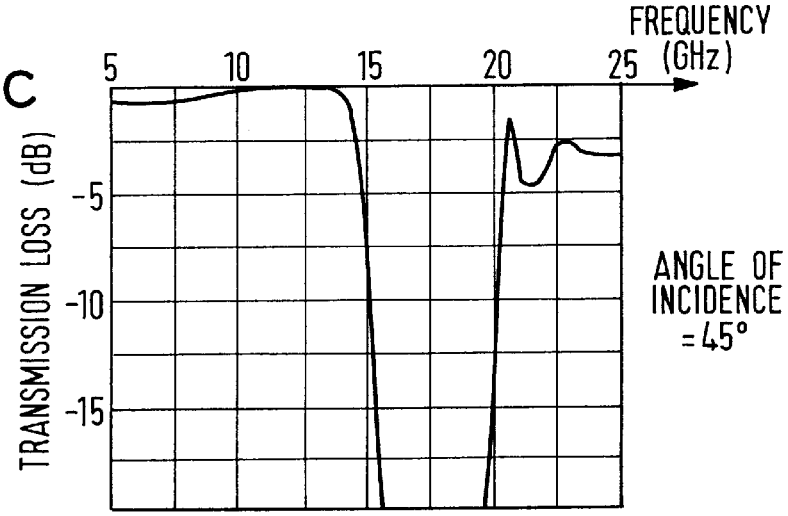
FIG. 13*c* is a graph similar to FIG. 13*a* and *b* wherein the angle of incidence is 45 degrees.

This technique is the well known Fabry-Perot etalon effect and, referring to FIG. 11*a*–11*c*, it will be seen that the effect of the reinforcement of the emerging waves is to widen the reflection band from what it would have been had a single layer of rings only been provided as in FIG. 11*a*. The dimensions are chosen so that the transmission band generated by the multiple reflections is at the upper edge of the lower transmission band, and therefore has the effect of increasing the roll-off at the transition (FIG. 11*b*), as well as widening the reflection band. The centre frequency of the reflection band in FIG. 11*a* is determined mainly by the mean diameter of the rings or more generally the physical size of the resonant elements.

It should be mentioned that a two layer form of the frequency selective surface device, that is, as in FIG. 9 but without the lower dielectric layer 15 and the lowest array of rings 14, is also within the scope of the invention. The addition of the second dielectric layer 15 and the third layer of rings 14 has the effect, as can be seen from FIG. 11*c*, of widening the lower transmission band and increasing still further the sharpness of the transition between the transmission and reflection bands.

The thickness of the dielectric is not exactly one half of one wavelength of the radiation in the dielectric, as explained, because a phase change occurs on reflection at each layer of rings. This is because, on reflection, currents are induced in the rings, and the induced currents then re-radiate energy. The re-radiated energy is generally not in phase with the incoming energy which generated the currents. The phase difference between each successive multiple of reflection is one wavelength when these phase lags have been taken into account. A typical actual thickness may be one quarter of a wavelength of the radiation in the substrate taking into account effects of angle of incidence and reflection phase effects.

It should be added that the performance curves of FIGS. 11*a*–11*c* are for illumination in the T.E. plane at 15° incidence. It will be noted that the centre resonant frequency of the single layer structure of FIG. 11*a* remains almost unchanged with the addition of the second layer as in FIG. 11*b* but the reflection band width increases substantially, and the ratio between the lower edge of the reflection band and the upper edge of the transmission band, both for 10% loss of energy, is 1.16:1. The addition of the third screen reduces the band spacing further to 1.07:1 while broadening the pass band width.

The device may be manufactured by photolithographic etching of the pattern onto a thin conducting layer on both sides of a wafer and on a single side of a second wafer, so that the substrates may then be mated together and permanently fixed by applying a thin bonding layer between one of the conducting arrays and the blank face of the second substrate. The rings could also be printed using other techniques such as laser cuting or ion milling to remove the unwanted conducting film. The use of resonant elements permits design freedom in that the resonant frequency depends on the diameter of the ring, while the spacing can be varied independently. The geometry can be designed using a rigorous Floquet modal analysis program. This is described for example in "Rings As Elements For Frequency Selective Surfaces" by E. A. Parker and S. M. A. Hamdy, Electron. Lett vol. 17 no. 17 pp 612–614.

Figure 14:
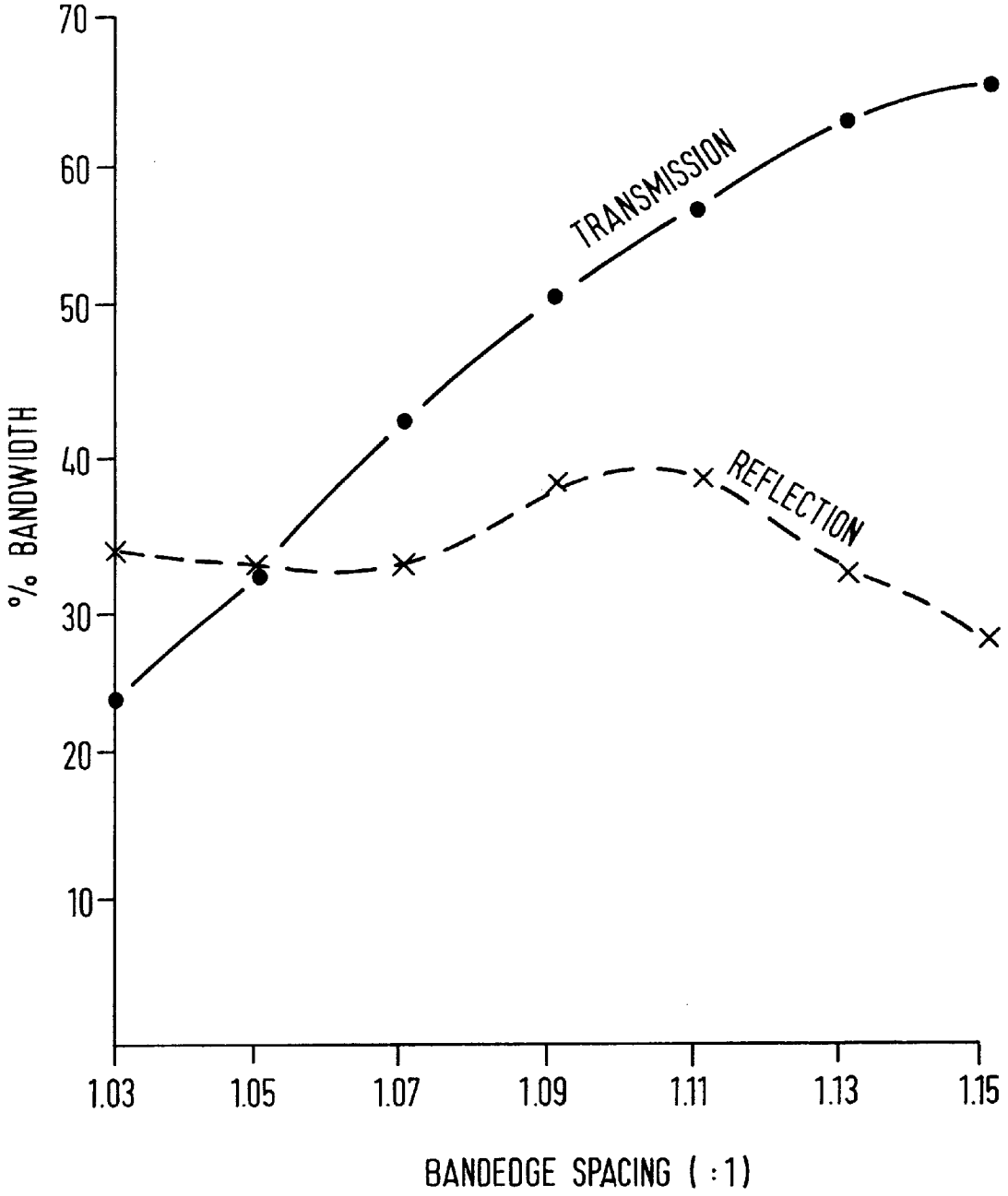
FIG. 14 is a graph illustrating the relation of percentage bandwidth with respect to band edge spacing for transmitted and reflected beams of electromagnetic radiation in the T.E. mode at an angle of incidence of 15 degrees to the frequency selective surface device of FIGS. 9, 10*a* and 10*b;*

The transmission response of the device of FIG. 9 for different angles of incidence, for orthogonal T.E. and T.M. planes is illustrated in FIGS. 12*a*–12*c* and FIG. 3*a*. The performance of the invention is thus reasonably insensitive to the angle and plane of incidence. FIG. 14 illustrates the trade-off between roll-off rate and transmission and reflection band widths for T.E. 15° incidence. The widths of the transmission and reflection bands are defined as the frequencies at which the filter loss is less than 10% (−0.5 dB). Similarly the percentage band width is defined over the range of frequencies where the loss does not exceed 10% i.e. $(F_U-F_L)/F_c\times100\%$.

Of course variations may be made without departing from the scope of the invention. Thus, the resonant elements are illustrated as circular rings, but they could be rings of non-circular form such as squares or loops of any shape. Instead, they could be tripoles 14'. For example, elements 14 in FIG. 10*a* could be patch elements in the well known tripole shape. U.S. Pat. No. 3,975,738 illustrates the tripole shape for slots. Whether patch elements or slots are used the shape would be the same, as is well known to those skilled in the art. As has been stated before the invention is also applicable to a double (as well as triple) layer of resonant elements.

The invention is also applicable to the conducting surfaces forming the rings etc being replaced by slots in a conducting layer. Such a layer e.g. of resonant ring-shaped slots would give an inverse response to that of the respective conducting ring-shaped structure. For example, in FIGS. 11*a*–11*c*; 12*a*–12*c*; 13*a*–13*c*, the lower transmission band would be a reflection band, and the reflection band would be a transmission band, and the device would be high pass instead of low pass. In FIG. 10*b*, the multiple internal reflections would be reinforced on emergence from the upper surface, instead of on being reinforced on emergence from the lower surface.

The invention is applicable to radiometers for terrestrial use, and over any frequency in the electromagnetic spectrum, with or without a reflector antenna, and whether the frequency selective surface device is used in free space as in FIG. 7, or is mounted in a waveguide as in FIG. 8. The invention is also applicable to radio receivers whether used for space-borne or terrestrial applications, whether employing a waveguide or not, whether employing a reflector or not.

Among alternative configurations for a reflector antenna, the invention is applicable to the Cassegrain principle, where the feed horn which extends through the reflector antenna will reflect from the back of a convex frequency selective surface, and a feed horn at the focus of the antenna will transmit through the frequency selective surface, so that both frequency channels are combined in the output of the antenna or to dual offset reflector antennas.

What is claimed is:

1. A frequency selective surface device for separating or combining two channels, which comprises at least two mutually spaced frequency selective surfaces, each frequency selective surface respectively defining a reflection band of frequencies between two transmission bands of frequencies, the respective reflection and transmission bands being the same for each of the frequency selective surfaces, each frequency selective surface comprising an array of coupled resonant elements which are resonant at only one series of frequencies, and wherein the spacing of the surfaces is such that radiation incident on the device undergoes multiple reflections between the frequency selective surfaces resulting in the reinforcement of these reflections on emergence to create a reflection band defined by said multiple reflections in the vicinity of said reflection band defined by each frequency selective surface, whereby the frequency selective surface device has a relatively sharp transition between a transmission band and a reflection band.

2. A frequency selective surface device as claimed in claim 1, in which said resonant elements are resonant loops.

3. The frequency selective surface device of claim 1 wherein the maximum spacing between the frequency selective surface is one half of one wave length between the surfaces in the range for which the device is operative.

4. A frequency selective surface device as claimed in claim 1, in which there are three frequency selective surfaces.

5. The device of claim 1 wherein said resonant elements are tripoles.

6. A radiometer including a frequency selective surface device for separating or combining two channels, which comprises at least two mutually spaced frequency selective surfaces, each frequency selective surface respectively defining a reflection band of frequencies between two transmission bands of frequencies, the respective reflection and transmission bands being the same for each of the frequency selective surfaces, each frequency selective surface comprising an array of coupled resonant elements which are resonant at only one series of frequencies, and wherein the spacing of the surfaces is such that radiation incident on the device undergoes multiple reflections between the frequency selective surfaces resulting in the reinforcement of these reflection on emergence to create a reflection band defined by said multiple reflections in the vicinity of said reflection band defined by each frequency selective surface, whereby the frequency selective surface device has a relatively sharp transition between a transmission band an a reflection band.

7. A frequency selective surface device for separating or combining two channels, which comprises at least two mutually spaced frequency selective surfaces, each frequency selective surface respectively defining a transmission band of frequencies between two reflection bands of frequencies, the respective transmission and reflection bands being the same for each of the frequency selective surfaces, each frequency selective surface comprising an array of coupled resonant elements which are resonant at only one series of frequencies, and wherein the spacing of the surfaces is such that radiation incident on the device undergoes multiple reflections between the frequency selective surfaces resulting in the reinforcement of these reflections on emergence to create a transmission band defined by said multiple reflections in the vicinity of said transmission band defined by each frequency selective surface, whereby the frequency selective surface device has a relatively sharp transition between a reflection band and a transmission band.

8. A frequency selective surface device as claimed in claim 7, in which said resonant elements are resonant loops.

9. The frequency selective surface device as claimed in claim 7, wherein the maximum spacing between the frequency selective surfaces is one half of one wavelength between the surfaces in the range for which the device is operative.

10. A frequency selective surface device as claimed in claim 7, in which there are three frequency selective surfaces.

11. The device of claim 7 wherein said resonant elements are tripoles.

12. A radiometer including a frequency selective surface device for separating or combining two channels, which comprises at least two mutually spaced frequency selective surfaces, each frequency selective surface respectively defining a transmission band of frequencies between two reflection bands of frequencies, the respective transmission and reflection bands being the same for each of the frequency selective surfaces, each frequency selective surface comprising an array of coupled resonant elements which are resonant at only one series of frequencies, and wherein the spacing of the surfaces is such that radiation incident on the device undergoes multiple reflections between the frequency selective surfaces resulting in the reinforcement of these reflections on emergence to create a transmission band defined by said multiple reflections in the vicinity of said transmission band defined by each frequency selective surface whereby the frequency selective surface device has a relatively sharp transition between a reflection band and a transmission band.

* * * * *